US006826122B2

(12) United States Patent
Zaugg

(10) Patent No.: US 6,826,122 B2
(45) Date of Patent: Nov. 30, 2004

(54) TIMEPIECE WITH DATE DISPLAY INCLUDING A RUNNING EQUATION OF TIME DEVICE

(75) Inventor: Alain Zaugg, Le Brassus (CH)

(73) Assignee: Frederic Piguet S.A., Le Brassus (CH)

( * ) Notice: Subject to any disclaimer, the term of this patent is extended or adjusted under 35 U.S.C. 154(b) by 345 days.

(21) Appl. No.: 10/207,790

(22) Filed: Jul. 31, 2002

(65) Prior Publication Data

US 2003/0031093 A1 Feb. 13, 2003

(30) Foreign Application Priority Data

Aug. 7, 2001 (CH) ..... 1457/01

(51) Int. Cl.[7] ..... G04B 19/24
(52) U.S. Cl. ..... 368/28; 368/80
(58) Field of Search ..... 368/15–20, 28, 368/35–38

(56) References Cited

U.S. PATENT DOCUMENTS 5,023,849 A * 6/1991 Vaucher ..... 368/15
5,184,333 A 2/1993 Caspar
5,473,580 A * 12/1995 Gilomen et al. ..... 368/28

* cited by examiner

*Primary Examiner*—Vit W. Miska
(74) *Attorney, Agent, or Firm*—Sughrue Mion, PLLC

(57) ABSTRACT

The present invention concerns a timepiece such as, in particular, a wristwatch, including a watch movement, a running equation of time device, as well as a date mechanism, this timepiece having a pair of hour (22) and minute (24) hands which indicate the civil time, and an additional minute hand (28) which indicates the true time, the daily position of the true time minute hand (28) with respect to the civil time minute hand (24) being determined by the position of an equation of time cam (32) driven in rotation at the rate of one revolution per year by a date mechanism, characterized in that the true time minute hand (28) is driven by a differential gear (50) which has for respective power take-off a gear train (52) driving the civil time minute hand (24) and a transmission member which co-operates with the equation of time cam (32) to transmit the pivoting movement of said cam (32) to the input of the differential gear.

11 Claims, 3 Drawing Sheets

TIMEPIECE WITH DATE DISPLAY INCLUDING A RUNNING EQUATION OF TIME DEVICE

The present invention concerns a timepiece including an equation of time mechanism with a display. More particularly, the invention concerns a running equation of time mechanism actuating a minute hand of the true time concentric to the set of hands of the movement.

As is known, there exists a time difference between the true solar time, which corresponds to the duration of time, which passes between two consecutive upper passages of the sun at the meridian of a same place, and the mean solar time or civil time which is the mean, over the year, duration of all the true solar days. This difference between the civil time and true time reaches +14 minutes 22 seconds on 11 February, and −16 minutes 23 seconds on November 4. These values vary only slightly from one year to the next.

In order to indicate the time difference between civil time and true time, certain timepieces include a so-called running equation of time mechanism, i.e. wherein the set of hands includes two concentric minute hands, one indicating the civil time, and the other the true time, the true time minute hand being actuated by an equation of time cam whose profile is determined by the difference between the mean solar time and the true time at a given moment.

The equation cam is driven in rotation at the rate of one revolution per year from a simple or perpetual calendar mechanism. The simple date mechanism is a mechanism capable of indicating the day of the week, the date of the month, the month of the year or even the phases of the moon, but which does not take account of the variation in the number of days in the month (months of 28, 29 or 30 days). In other words, the user of a watch having a simple date mechanism has to make a manual adjustment at the end of months which include less than 31 days. For example, on 28 February or 30 April, a manual adjustment will have to be made. As regards the perpetual calendar, like the simple date mechanism, it indicates the day, date, month and phases of the moon. However, unlike the simple date mechanism, the perpetual calendar mechanism automatically takes account of the length of the months (28, 29 and 30 days), without any manual intervention. A perpetual calendar mechanism thus automatically takes account of leap years.

An example of a perpetual calendar timepiece movement including a running equation of time mechanism is given by Swiss Patent No. 689 359 in the name of the Swiss company Patek Philippe.

The Patek running equation of time mechanism is supported by a support driven by a minute wheel of the watch movement. It is mainly formed of a friction wheel frictionally engaged on the support and a running equation pinion mounted on the support and including a pipe whose free end carries the true time minute hand. Two locking levers are pivoted on the support. They surround the friction wheel and are arranged such that when one of them is moved away from the friction wheel, so is the other one and, conversely, when a return spring, fixed onto the support, applies one of the levers against the periphery of the friction wheel, the other lever is also applied against the periphery of the friction wheel. One of the locking levers includes a control finger, which co-operates with a running equation lever one of the ends of which is applied against the periphery of the equation of time cam.

The running equation of time mechanism which has just been described hereinbefore operates as follows. The running equation lever is placed on the trajectory of the control finger with which one of the locking levers is provided. When the support, driven by the minute wheel, is rotating, the control finger is moved by the running equation lever, which causes the locking levers to move against the action of the return spring and the friction wheel to be released. At this moment, two racks which mesh with the running equation pinion cause the true time minute wheel to move backwards until a stud, with which one of the two racks is provided, comes into contact with the running equation lever. In a subsequent rotation of the support, the two locking levers again lock the friction wheel on the support. As regards the exact position for the true time minute hand, this is determined by the position of the positioning stud when it reaches the end of the running equation lever. The true time minute hand then returns forwards to its exact position for a given day.

The Patek mechanism advantageously enables a running equation of time timepiece to be made, i.e. having two concentric minute hands, one indicating the civil time and the other indicating the true time. This timepiece can be reset to the time by the user himself after stopping for an indeterminate period of time, since an equation cam driven by the perpetual calendar defines the determination of the time difference between the two-minute hands. The Patek construction includes, however, a significant number of moving parts, which poses the problem of its operating reliability. Moreover, because of the large number of parts of which it is formed, the Patek construction proves bulky, making it more suitable for pocket watches than wristwatches. Finally, it should also be noted that the use of a friction wheel as the main member of the Patek mechanism poses the problem of the rapid wear of this type of mechanism because of the gradual slackening of the resilient forces brought into play.

The object of the present invention is to resolve the aforementioned problems, in addition to others by proposing a running equation of time device, which is of simple construction and the operation of which satisfies all the necessary requirements of reliability.

The present invention therefore concerns a timepiece including a watch movement, a running equation of time device, as well as a date mechanism, this timepiece having a pair of hour and minute hands which indicate the civil time, and an additional minute hand which indicates the true time, the daily position of the true time minute hand with respect to the civil time minute hand being determined by the position of an equation of time cam driven in rotation at the rate of one revolution per year by a date mechanism, characterised in that the true time minute hand is driven by a differential gear which has for respective power take-off a gear train driving the civil time minute hand and a transmission member which co-operates with the equation of time cam to transmit the pivoting movement of said cam to the input of the differential gear As a result of these features, the present invention provides a running equation of time device including a very small number of parts, such that it is compact and can be housed in any type of timepiece such as, in particular, a wristwatch. Moreover, the limited number of parts used guarantees that the equation of time device according to the invention operates reliably without breaking down. It should also be noted that the position of the true time minute hand is corrected once a day only, generally between 23 hours and midnight, when the date mechanism passes from one day to the next day. The person wearing the watch thus does not see the true time minute hand jumping at each hour change, as is the case with the running equation of time mechanisms of the prior art, which are driven by the watch motion-work. The feeling of confidence that the user experiences with respect to his watch is thus increased. Finally, the position of the minute hand indicating the true time is determined with precision insofar as the transmission member which forms one of the power take-offs of the differential gear, is directly meshed with the equation of time cam, which allows any play between said cam and said differential gear to be removed.

Other features and advantages of the present invention will appear more clearly from the following description of an embodiment example of the timepiece according to the invention, this example being given purely by way of non-limiting illustration, in conjunction with the annexed drawings, in which.

The present invention proceeds from the general inventive idea consisting in carrying the true time minutes display hand by a differential gear whose two power take-offs are formed, on the one hand by the motion-work of the watch movement, and on the other hand by the equation of time cam which is driven at the rate of one revolution per year by the date mechanism. The true time minute hand is thus directly meshed with the motion-work, such that the time difference, which separates it from the civil time minute hand, remains perfectly constant over a period of 24 hours separating two successive date changes. It is also directly meshed with the equation of time cam that determines precisely, during each daily correction, its position relative to the civil time display hand.

The present invention will be described in conjunction with a timepiece of the wristwatch type including a running equation of time mechanism actuated by an equation of time cam, itself driven in rotation at the rate of one revolution per year by a date mechanism which may either be simple or perpetual. In the case of a simple date mechanism, the true time minute hand can be reset to the time by the user himself at the end of the months of the year comprising less than 31 days since the determination of the time difference between the two true time and civil time minute hands is defined by the equation of time cam driven by the date mechanism. Thus, when the date is reset, the equation of time cam is automatically placed in its exact position for the given day.

In the following description, the watch movement will not be described in its entirety, but only the running equation of time mechanism with its display means.

Figure 1:
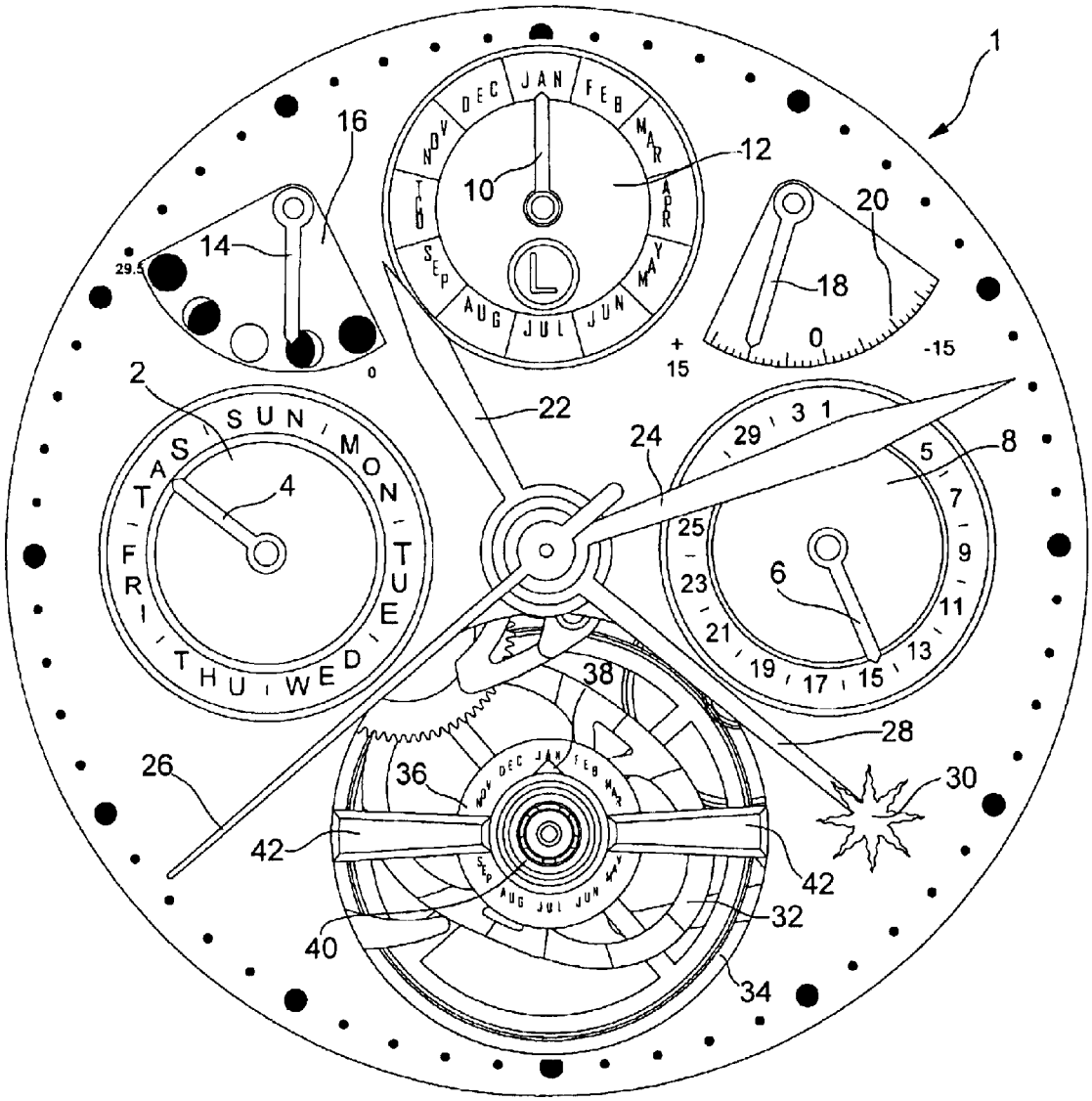
FIG. 1 is a plan view of the dial of a timepiece with complications according to the invention.

The timepiece according to the invention includes, in particular, a dial a plan view of which is shown in FIG. 1. Designated as a whole by the general reference numeral 1, the dial provides the person wearing the watch with various information. It indicates, first of all, in a first small dial 2, the day of the week (optional display). FIG. 1 shows that the indication of the day of the week is achieved via a hand 4. Of course, hand 4 could be replaced by a disc, which would bear the marking of the days of the week, and which would rotate under the dial allowing the name of the day of the week to appear through an aperture made in said dial and called a window. A second hand 6 moving above another small dial 8 indicates the date (from 1 to 31) or day of the month. Finally, the watch provides an indication of the month via a hand 10, which moves above a dial 12 on which the names of the various months of the year are marked.

In addition to the indications linked to the date, the watch according to the present invention may also indicate the phases of the moon by means of a hand 14 moving above a dial 16 on which the various quarters of the moon are represented, allowing one to see whether the moon is growing, is full, decreasing or new (optional display). The watch according to the invention also provides an indication as to the equation of time for the day, which is the difference between the true solar time and the mean solar time or civil time (optional display). As has already been explained hereinbefore, this difference between true time and civil time arises from the inequality of the daily path of the Earth along its elliptical trajectory around the sun. As can be seen in FIG. 1, the time difference between the civil time and true time is indicated on dial 1 of the watch by means of a hand 18, which moves facing a time scale 20. This time scale 20 is graduated in minutes and extends between −15 and +15 minutes, which substantially corresponds to the maximum advance and lag which civil time can take with respect to true time over a year.

The object of the present invention is, however, not to combine a date mechanism and a simple display of the time differences between civil time and true time of the type described hereinbefore, but to integrate a running equation of time mechanism in a watch, i.e. wherein the set of hands includes two concentric minute hands, one indicating civil time and the other indicating true time. Thus, as can be seen in FIG. 1, the timepiece according to the invention includes, in addition to a conventional set of hands whose role is to indicate civil time and which includes an hour hand 22, a minute hand 24 and a second hand 26 moving above dial 1, a second minute hand 28, concentric to civil time minute hand 24, and which indicates true time. In order to allow the person wearing the watch to easily distinguish between civil time minute hand 24 and true time minute hand 28, this latter may end, for example, in a representation of the astrological symbol of the sun 30. As will be seen in more detail in the present description hereinafter, the exact position of true time minute hand 28 for a given day is determined every day (once every 24 hours) at around midnight, then the two civil time and true time minute hands 24 and 28 move together, the time difference between these two hands 24 and 28 remaining constant for the given day.

FIG. 1 also shows a part of the running equation of time mechanism according to the invention, and particularly equation of time cam 32 whose profile, let us recall, is determined by the difference between the mean solar time or civil time and true time at a given moment. In order to make equation of time cam 32 visible through dial 1, a circular aperture 34 has had to be made therein. It should however be understood that such an arrangement obeys only reasons of a purely aesthetical nature. Indeed, the fact of making the equation of time mechanism at least partially visible to the eye reinforces the attraction a user may feel for his watch, but plays absolutely no role in the operation of said running equation mechanism.

Again with reference to FIG. 1, it can be seen that the equation of time cam 32 carries a disc 36 which rotates at the same speed as said cam, namely at the rate of one revolution per year. Disc 36 has transfers with the first three letters of the name of the month, whereas a cursor 38 indicates a given month. Cursor 38 is arranged on the external periphery of a second disc 40 arranged above the month of the year disc 36 and is concentric thereto. Disc 40 which carries cursor 38 is fixedly mounted on the frame of the watch in any appropriate manner, for example via two radial arms 42 as is shown in FIG. 1.

It will be noted, upon examining FIG. 1, that cursor 38 associated with the running equation of time mechanism and hand 10 of the date device indicate the same month, in this case the month of January. It should be understood that, when the user resets his watch to the correct time after a stop of undetermined duration or when he has to intervene manually in order to correct the date at the end of every month of less than 31 days in the event that a simple date mechanism is used, he must be able to make the position of equation of time cam 32 coincide with the date indicated by the date mechanism so that true time minute hand 28 indicates the exact solar time.

Although the advantage of a watch having a perpetual calendar is that there is no need to correct the date at the end of the month, it may happen that, for one reason or another, the watch stops, and its indications have to be manually corrected. It is for this reason that a perpetual calendar has correctors, just like a simple date mechanism. The watch according to the invention visible in FIG. 1 thus includes a multitude of correctors (not shown in the drawing) among which there is a general corrector which allows the day, date and month to be simultaneously corrected, and auxiliary correctors independent of each other for correcting respectively either the day, the date or the month. In quick correction phase, i.e. when only one of the items of information displayed by the watch is modified, the date and running equation mechanisms are uncoupled. An additional corrector must thus be provided to make the solar time indicated by true time minute hand 28 coincide with the data provided by the date mechanism.

Figure 2:
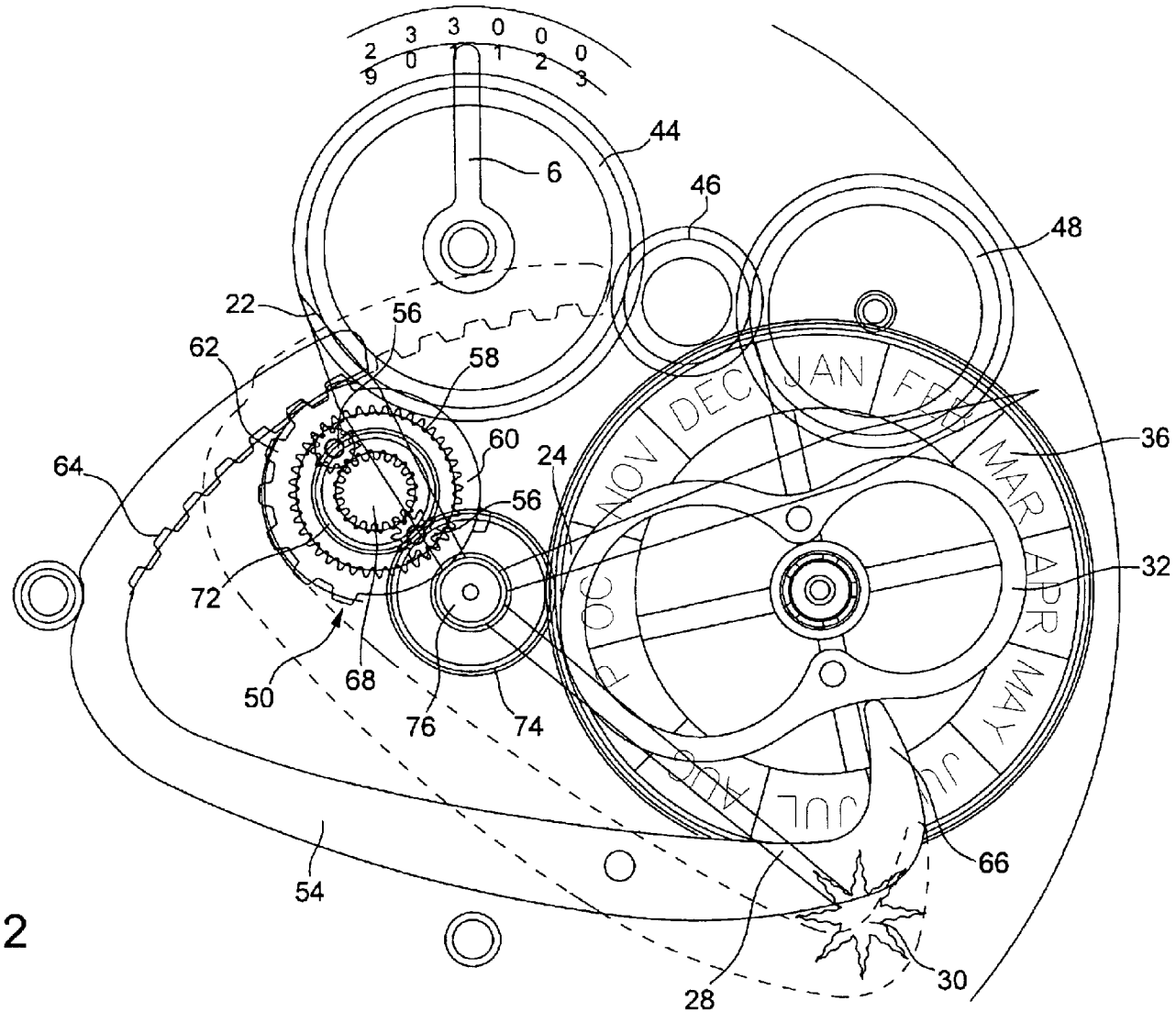
FIG. 2 is a plan view of the running equation of time device according to the invention.
Figure 3:
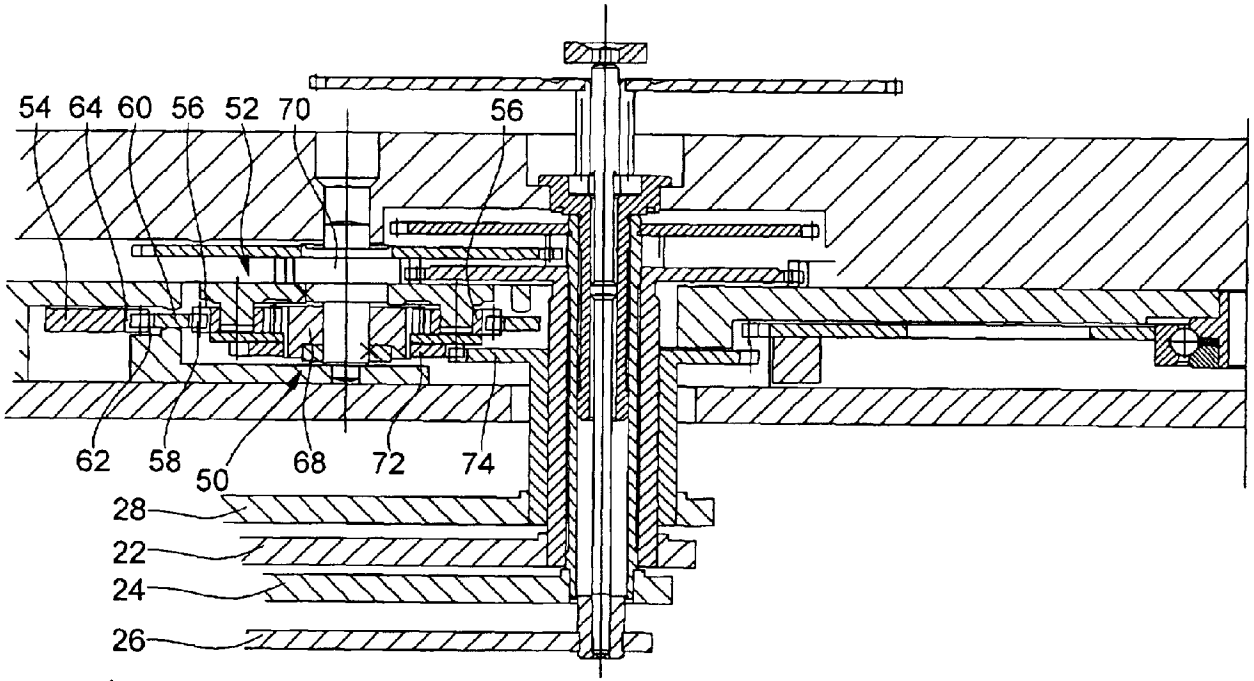
FIG. 3 is a first cross-section of the timepiece shown in FIG. 1 in which the running equation mechanism is shown.
Figure 4:
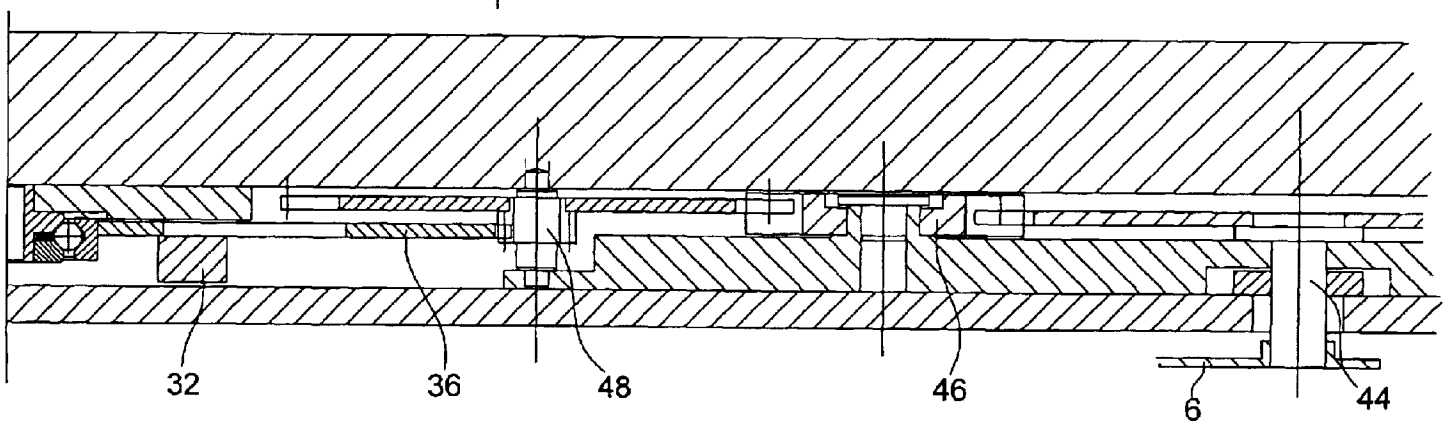
FIG. 4 is a similar cross-section to that of FIG. 3 in which a part of the date mechanism is shown.

We will now consider the running equation of time mechanism according to the invention with reference to FIGS. 2 to 4 annexed to the present patent application. FIG. 2 shows, in particular, the aforementioned equation of time cam, whose profile is determined by the difference, for each day of the year, between the mean solar time or civil time and true solar time. Equation of time cam 32 is driven in rotation at the rate of one revolution per year by the simple date or perpetual calendar mechanism included in the timepiece. As already described hereinbefore, cam 32 carries a month disc 36 which rotates at the same speed as cam 32 and which enables the position of said cam 32 to be made to coincide with the date indicated by the date mechanism so that true time minute hand 28 indicates the exact solar time.

The simple or perpetual date mechanism may be of any known type and will not be described here in its entirety. In order to understand the invention properly, one only needs to know that the date mechanism drives equation of time cam 32 at the rate of one complete revolution per year. There is however shown, purely for the purposes of illustration, a date wheel set 44 driving the aforementioned hand 6 which indicates the date (from 1 to 31). This date wheel set 44 rotates at the rate of one complete revolution per month. It is activated by the date mechanism via an intermediate date wheel 46 for reversing the direction of rotation, and a gear reduction wheel 48 for reducing the rotational speed from one complete revolution per month to one complete revolution per year.

In accordance with the invention, true time minute hand 28 is driven by a differential gear 50 which has for respective inputs a gear-train 52 driving civil time minute hand 24 and a rack 54 which co-operates with equation of time cam 32 (rack 54 is shown in FIG. 2 in its two end positions, once in full lines and the other time in dot and dash lines). More precisely, as can be seen in FIG. 2, differential gear 50 includes at least one, and preferably two planetary wheels 56 driven by the motion-work of the watch movement. These two planetary wheels 56 are able to rotate on themselves and to roll over inner toothing 58 of an equation of time wheel 60. The latter also has on its external periphery a toothed sector 62 via which it co-operates with a toothed sector 64 on one of the ends of rack 54. This rack is subjected to the return action of a spring (not shown) which is fixed to the watch frame and which tends to apply feeler 66 forming the other end of said rack 54 against the periphery of running equation of time cam 32. The true time display train includes a pinion 68 placed at the centre of differential gear 50 and carried by a staff 70. True time display pinion 68 meshes with planetary wheels 56. It also carries a display wheel 72 which meshes with a cannon-pinion 74 onto the pipe of which true time minute hand 28 is driven. This gear train 72, 74 enables the solar time display to be returned to the centre 76 of the watch movement, such that true time minute hand 28 is concentric to civil time minute hand 24.

The running equation of time mechanism, which has just been described, operates in the following manner.

In the normal operating mode of the watch, equation of time cam 32, equation of time rack 54 and thus equation of time gear train 60, are stationary. Conversely, the watch movement drives planetary wheels 56. They therefore rotate on themselves and roll over the inner toothing 58 of equation of time wheel 60, driving true time display pinion 68 in rotation, which enables true time minute hand 28 to rotate concomitantly with civil time minute hand 24. The time difference between true time hand 28 and civil time hand 24 therefore remains constant over a period of 24 hours.

Once a day, at around midnight, running equation of time cam 32 pivots, driven by the date mechanism which causes the date to pass from one day to the next. At this precise moment, feeler 66, which is in contact with the periphery of cam 32 in turn, pivots rack 54. Said rack 54, by pivoting, drives equation of time wheel 60 in rotation. Since planetary wheels 56 are, during this brief time interval, substantially stationary (they make one complete revolution in one hour), they rotate on themselves being driven in rotation by equation of time wheel 60, and in turn drive true time display pinion 68 so as to adjust again the position of true time minute hand 28 exactly.

It goes without saying that the invention is not limited to the embodiments, which have just been described, and that various simple modifications and variants may be envisaged without thereby departing from the scope of the present invention.

What is claimed is:

1. A timepiece, such as particularly, a wristwatch or pocket watch, including a watch movement, a running equation of time device, as well as a date mechanism, this timepiece having a pair of hour and minute hands which indicate the civil time, and an additional minute hand which indicates the true time, the daily position of the true time minute hand with respect to the civil time minute hand being determined by the position of an equation of time cam driven in rotation at the rate of one revolution per year by a date mechanism, wherein the true time minute hand is driven by a differential gear which has for respective power take-off a gear train driving the civil time minute hand and a transmission member which co-operates with the equation of time cam to transmit the pivoting movement of said cam to the differential gear.

2. The timepiece according to claim 1, wherein the transmission member which co-operates with the working equation of time cam is a rack which has a toothed sector at one of its ends and which is subjected to the return action of a spring which tends to apply the feeler-spindle forming the other end of the rack against the periphery of the working equation of time cam.

3. The timepiece according to claim 2, wherein the true time minute hand is driven by a true time display train including a pinion placed at the centre of the differential gear and which is carried by a staff.

4. The timepiece according to claim 3, wherein the true time display pinion meshes with a gear train which enables the solar time display to be returned to the centre of the movement, such that the true time minute hand is concentric to the civil minute hand.

5. The timepiece according to claim 3, wherein the gear train which drives the civil time minute hand includes at least one planetary wheel, which meshes with the true time display pinion.

6. The timepiece according to claim 4, wherein the gear train which drives the civil time minute hand includes at least one planetary wheel, which meshes with the true time display pinion.

7. The timepiece according to claim 5, wherein the planetary wheels are capable of rotating on themselves and rolling over the inner toothing of an equation of time wheel which co-operates with the working equation of time cam via the rack.

8. The timepiece according to claim 6, wherein the planetary wheels are capable of rotating on themselves and rolling over the inner toothing of an equation of time wheel which co-operates with the working equation of time cam via the rack.

9. The timepiece according to claim 7, wherein the equation of time wheel has on its external periphery a toothed sector via which it co-operates with the toothed sector of the rack.

10. The timepiece according to claim 8, wherein the equation of time wheel has on its external periphery a toothed sector via which it co-operates with the toothed sector of the rack.

11. The timepiece according to claim 1, wherein the date mechanism is of the simple or perpetual type.

* * * * *